United States Patent [19]

Richardson

[11] 4,432,667

[45] Feb. 21, 1984

[54] INSULATION OF TUNNEL LININGS

[75] Inventor: Michael A. Richardson, Hindhead, England

[73] Assignee: Marcon International Limited, Saint Peter Port, Channel Islands

[21] Appl. No.: 158,302

[22] Filed: Jun. 10, 1980

[30] Foreign Application Priority Data

| | | | |
|---|---|---|---|
| Jun. 16, 1979 | [GB] | United Kingdom | 7921033 |
| Aug. 22, 1979 | [GB] | United Kingdom | 7929152 |
| Sep. 1, 1979 | [GB] | United Kingdom | 7930401 |

[51] Int. Cl.[3] ..... E21D 9/00; E21D 9/06; E21D 11/00

[52] U.S. Cl. ..... 405/143; 405/146; 405/150

[58] Field of Search ..... 405/141, 143, 146, 150, 405/184, 138, 135; 175/61, 76, 73–75

[56] References Cited

U.S. PATENT DOCUMENTS

| | | | |
|---|---|---|---|
| 2,946,578 | 7/1960 | De Smaele . | |
| 3,005,314 | 10/1961 | Cunningham | 405/138 |
| 3,169,376 | 2/1965 | Cunningham | 405/150 |
| 3,180,437 | 4/1965 | Kellner . | |
| 3,422,631 | 1/1969 | Silverman . | |
| 3,708,984 | 1/1973 | Coleman | 405/184 |
| 3,881,776 | 5/1975 | Fashbaugh . | |
| 3,919,851 | 11/1975 | Plourde | 405/143 |
| 4,095,435 | 6/1978 | Uemura . | |
| 4,095,655 | 6/1978 | Still . | |

FOREIGN PATENT DOCUMENTS

| | | |
|---|---|---|
| 1104468 | 11/1961 | Fed. Rep. of Germany . |
| 1157162 | 5/1964 | Fed. Rep. of Germany . |
| 2621391 | 11/1977 | Fed. Rep. of Germany . |
| 2741304 | 3/1979 | Fed. Rep. of Germany . |
| 999822 | 7/1965 | United Kingdom . |

*Primary Examiner*—David H. Corbin
*Assistant Examiner*—Nancy J. Stodda
*Attorney, Agent, or Firm*—Larson and Taylor

[57] ABSTRACT

A tunnel or shaft lining is installed nondisruptively in a medium such as soil by longitudinally advancing an assembly (10) of tunnel lining sections (12-1 to 12-8) arranged in end-to-end relationship and having an inflatable torus (22- 1 to 22-7) interposed between adjacent sections. Worm-like advancement is effected by simultaneously inflating in sequence the tori 22-1, 22-4, 22-7 etc.; the tori 22-2, 22-5 etc. and the tori 22-3, 22-6 etc., and repeating the inflation procedure as necessary until sufficient advance has been achieved.

15 Claims, 24 Drawing Figures

INSULATION OF TUNNEL LININGS

INSTALLATION OF TUNNEL LININGS

This invention relates to the installation of tunnel linings, which term as used herein is intended to include shaft linings and underground pipelines.

A known method for the distruptive subterranean installation of monolithic tunnel lining sections is to hydraulically jack the sections through the ground from a working shaft to a receiving shaft.

The hydraulic jacks in the working shaft are provided with a suitable reaction wall normally situated at the rear of the shaft. The leading section is provided with a cutting edge or is constituted by a shield within which material in way of the tunnel is excavated by mechanical or manual methods and removed to ground level.

As the tunnel progresses, so additional sections are added at the working shaft until the required length of tunnel is achieved.

To carry out this technique it may be necessary to provide jacking forces of several hundred tons to push the lining through the ground. Substantial reaction walls have to be provided to accommodate this jacking force and the sections may need to be of greater wall thickness than is required to withstand the designed earth pressures acting upon the tunnel lining after installation.

According to the present invention there is provided a method of non-disruptively installing a tunnel or shaft lining through a medium such as soil by longitudinally advancing an assembly of tunnel lining sections arranged in end to end relationship, which comprises advancing the sections in succession, each section being advanced by inflating and deflating an inflatable torus interposed between the section and the section behind it while restraining the outward expansion of the torus and preventing backwards movement of the rearward section. The lining may have a non-circular cross-section and the torus a corresponding shape.

This invention thus eliminates the need for traditional hydraulic jacking arrangements, reduces the structural requirements for the monolithic lining sections, minimises the size of working shafts and eliminates the need for a substantial reaction wall.

The method is based upon the fact that movement of the tunnel lining section in the forward, longitudinal direction is caused by the force exerted by the torus in attempting to achieve a substantially circular cross-section under the action of the driving fluid, the amount of forward movement being dependent upon the quantity of driving fluid admitted to the torus.

According to a further aspect of the present invention there is provided an assembly of tunnel lining sections for the non-disruptive installation of a tunnel lining, the assembly comprising two tunnel lining sections arranged end-to-end and externally rebated at the adjacent ends, a cylindrical sleeve in which the rebated ends are received with at least one end being slidingly received, an inflatable torus accommodated in the annular space defined by the adjacent end faces and the respective sleeve and supply and exhaust means to admit driving fluid to, and to exhaust driving fluid from, the torus.

Such a tunnel lining assembly consisting of a multiplicity of lining sections and corresponding tori can be given perichaetial (i.e. worm-like) movement in the forward direction by arranging that any particular section is subjected to the force of the inflated torus at its rearward end when at least the two immediately rearward sections are engaged at their common junction with or without the interposition of a deflated torus. This arrangement is necessary to achieve the perichaetial movement of the sections because the combined friction of the soil on the two rearward sections provides a reaction by which the lining section to be moved can be thrust forward by the torus when the latter is inflated by driving fluid.

For a tunnel lining comprising a multiplicity of lining sections to be movable in the forward direction as described above it is necessary for driving fluid to be admitted to and released from every third torus along the assembly.

This may be achieved using remote controlled slave valves situated at or near the inlet provided to each torus and arranged to operate in the sequence required by a remote control master valve situated in the working shaft of the tunnel. However, this arrangement is complicated and requires a feedback connection from each of the valves to the master valve for each of the operating tori.

A simpler method of achieving the required sequence of inflation of the operating tori is to have three driving fluid mains running inside the tunnel, each main being provided with lateral connections to one of the three groups of every third torus.

When a driving fluid is admitted to and exhausted from any particular one of the three driving fluid mains, every third torus will be inflated and deflated respectively such that when a driving fluid is admitted and exhausted to each of the three mains in turn, perichaetial forward motion of the assembly will take place.

The need for complicated valve arrangements is thus eliminated as there are required only three valves, one at the inlet of each of the three mains, and arranged to operate in a fixed sequence.

An alternative arrangement is to have a single supply main and a valve controlling the inlet to each torus, each valve being fluidically or electrically or manually operated by one of three pilot lines.

Tunnels are conventionally constructed using a tunnel shield within which a mechanical excavator may be arranged to operate. Alternatively, the shield may be used to safeguard the welfare of miners excavating the soil by hand or by power-assisted tools.

Prior art tunnel shields normally take the form of a cylindrical or right section steel tube or box and are provided with a multiplicity of hydraulic shove rams such that the tunnel shield may be propelled forward by the rams pushing off prefabricated sections of tunnel lining installed in the rear of the tunnel shield. Steering of the shield is achieved by differential shoving by the rams such that a turning couple is produced in the direction of steering required.

An alternative type of tunnel shield is described in British Pat. No. 1,545,879 where propulsion is achieved using a substantially coaxial driving cylinder to propel the shield off the prefabricated sections of tunnel lining.

Where tunnels are constructed according to the present invention, a convenient way of propelling the tunnel shield is to arrange for the leading inflatable torus to exert its thrust on the shield in an axially offset position to create a couple thus causing the shield and thus the tunnel lining to diverge from a rectilinear path.

According to this aspect of the present invention there is preferably provided a tunnel shield including a radially extending bulkhead situated upon which are a plurality of hydraulic rams whose pistons bear in an articulated manner upon a thrust ring inclinable to a plane normal to the shield axis. Engaged with the rear face of the thrust ring is the leading inflatable flexible torus.

Some embodiments of the invention will now be described, by way of example only, with reference to the accompanying drawings in which FIG. 1 is a vertical longitudinal section through an assembly of tunnel lining sections according to the invention;

Figure 1:
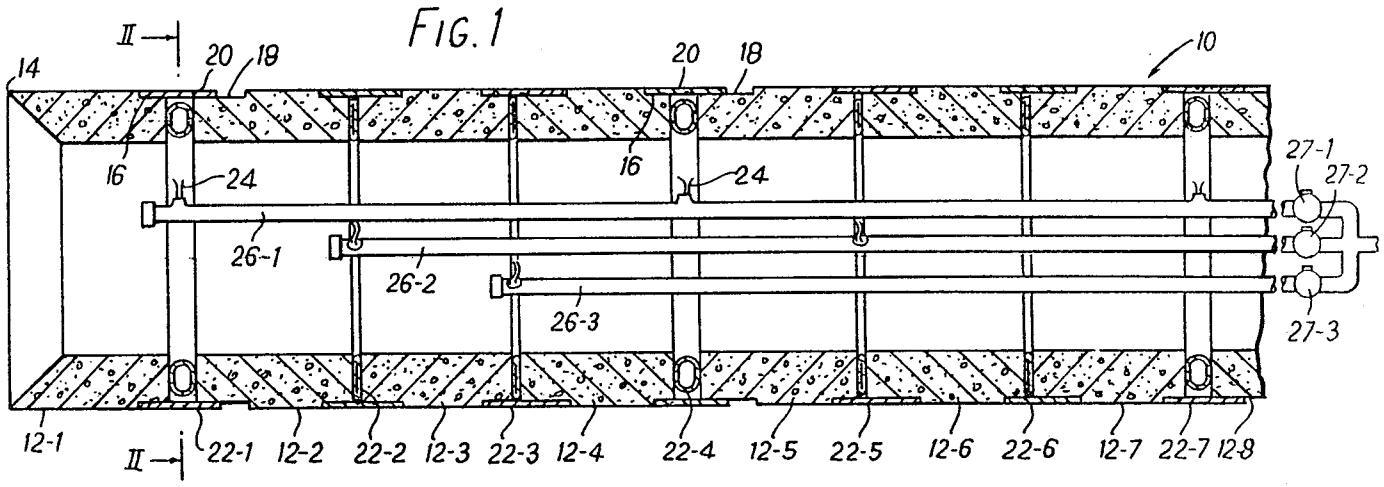
Figure 2:
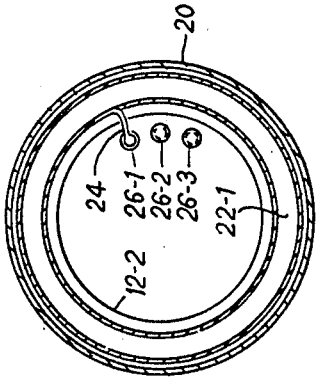
FIG. 2 is a radial section on the line II—II in FIG. 1.
Figure 6:
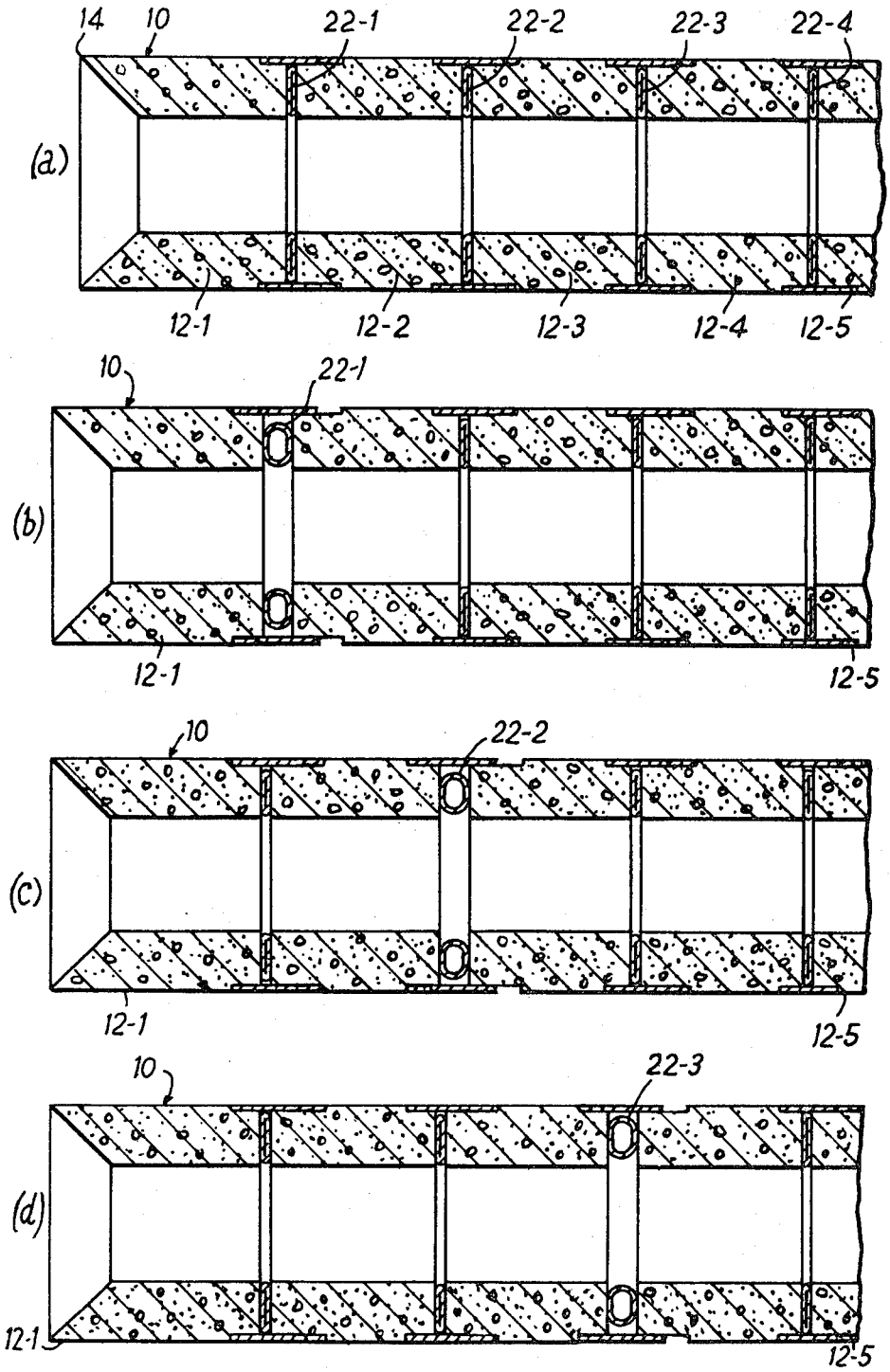
Figure 7:
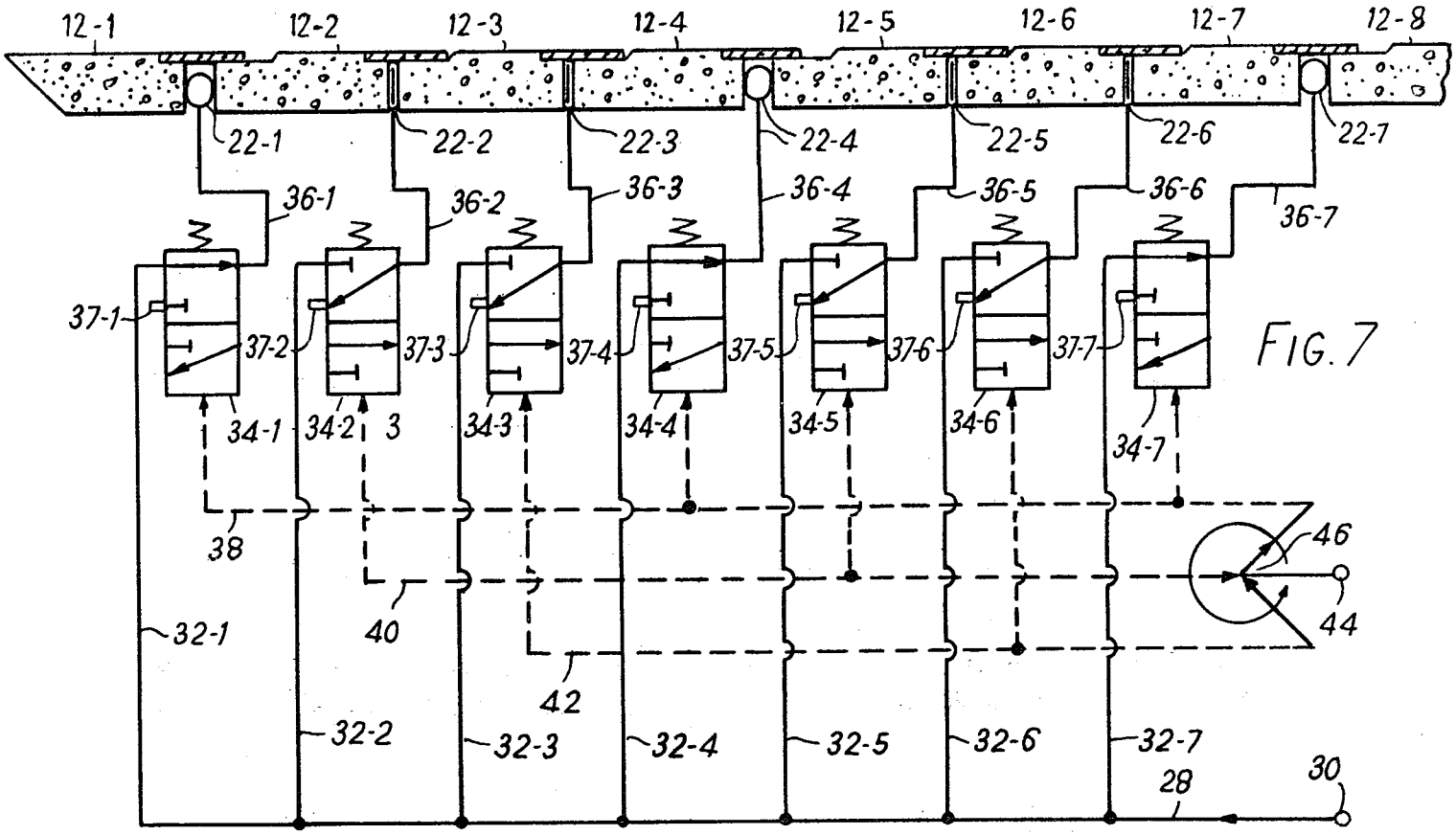
Figure 8:
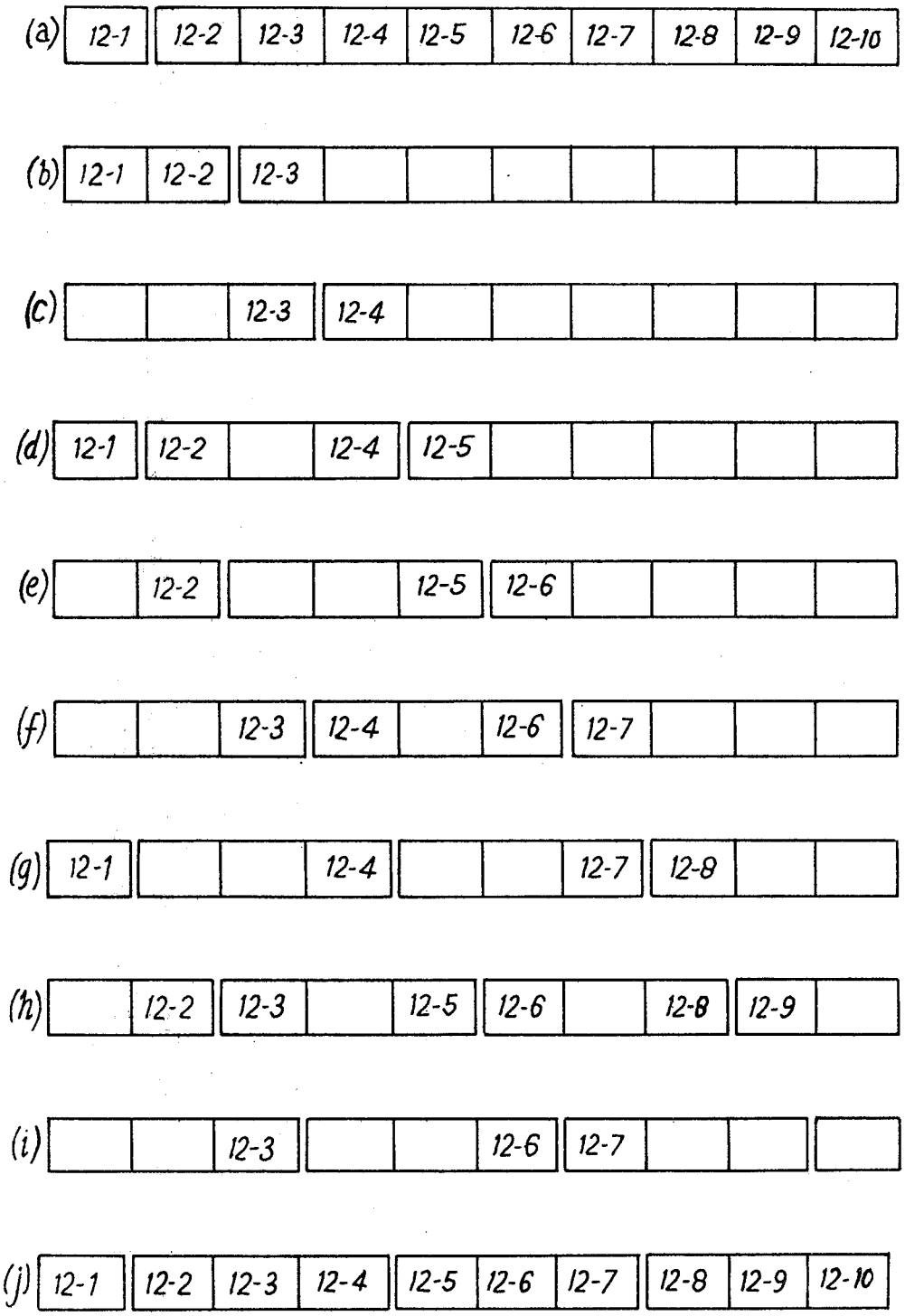
Figure 9:
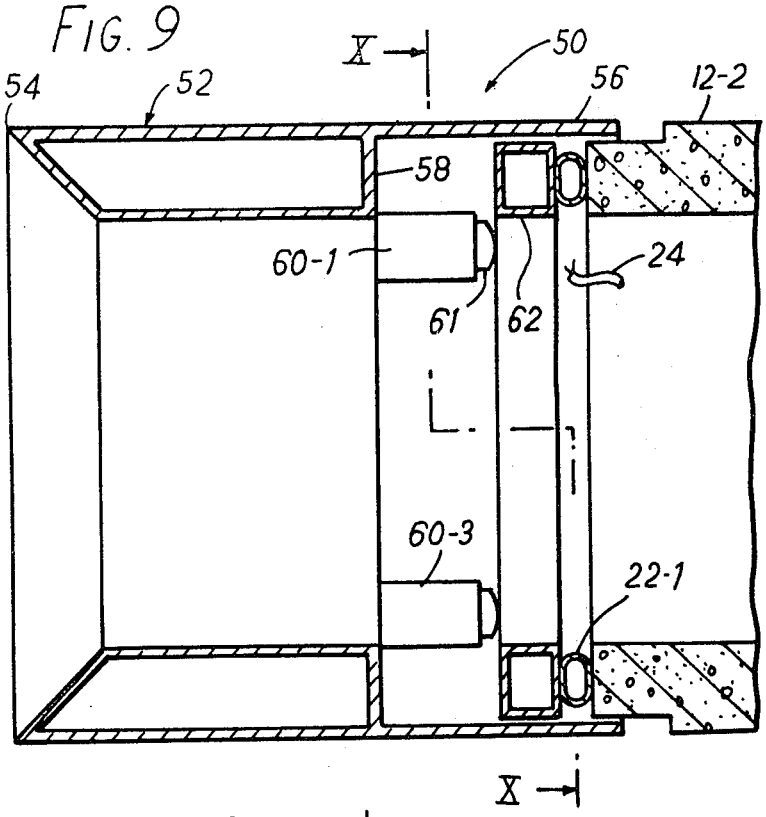
Figure 10:
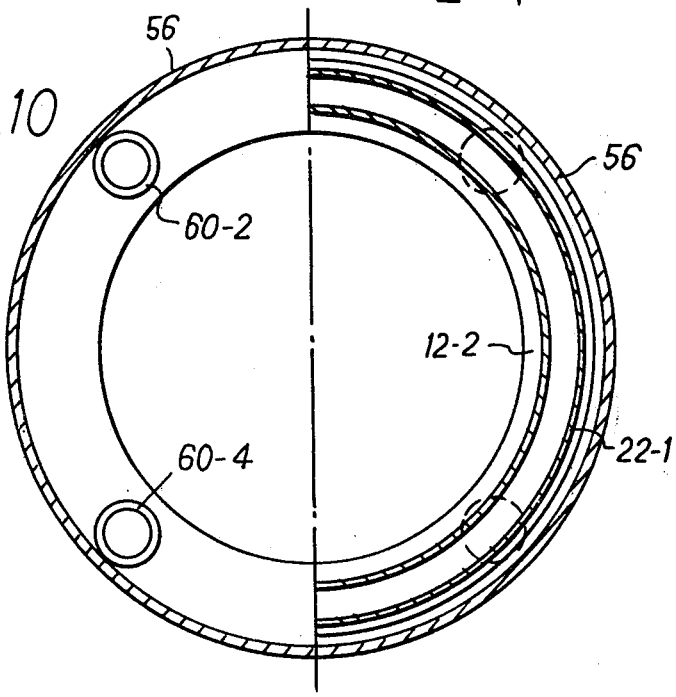
Figure 11:
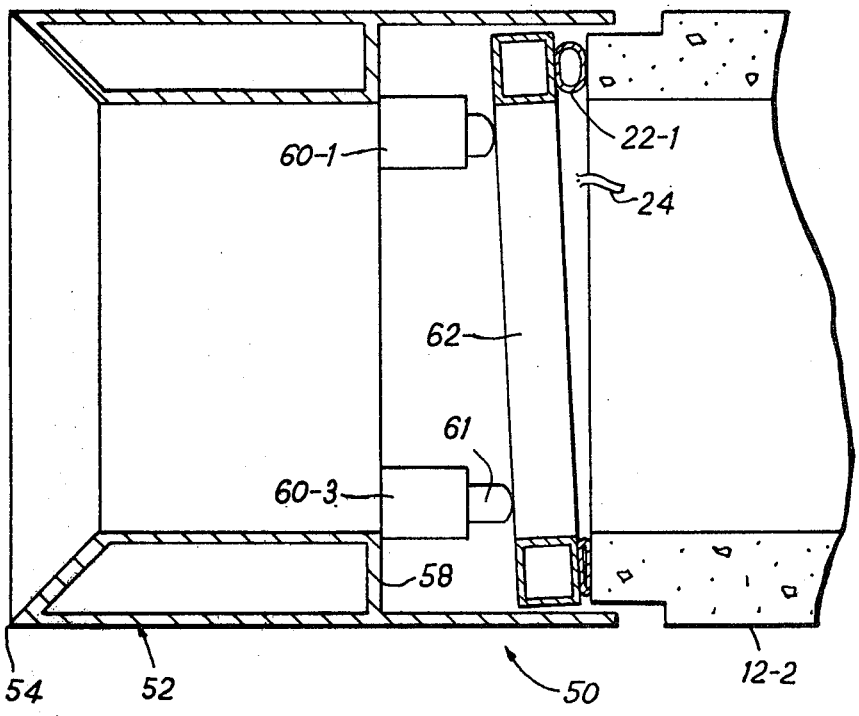
Figure 12:
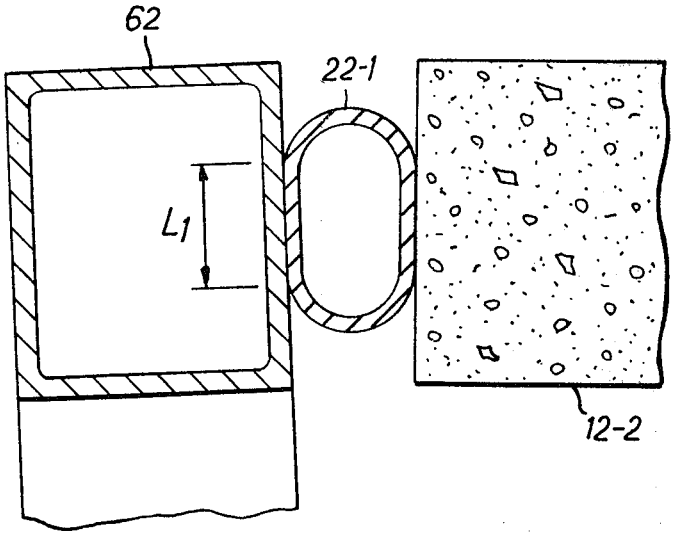
Figure 13:
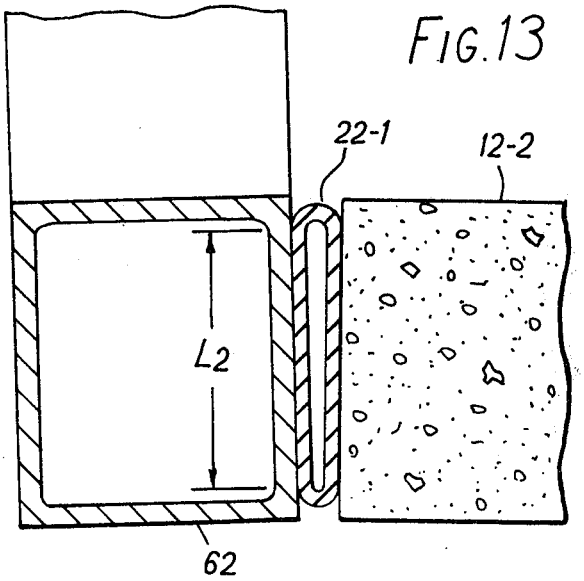

FIGS. 6(*a*) to 6(*d*) are a series of views each similar to that of FIG. 1, but with parts omitted, showing successive stages in the advance of the assembly;

FIG. 7 is a diagram showing a modified fluid supply;

FIGS. 8(*a*) to 8(*j*) are a series of block diagrams showing stages in the advance of an extended assembly;

FIG. 9 is a vertical longitudinal section through the leading end of a steerable modification of the assembly of FIG. 1;

FIG. 10 is a section on the lines X—X in FIG. 9;

FIG. 11 is a section similar to that of FIG. 9 with parts arranged to steer the assembly in an upward direction;

FIGS. 12 and 13 are details of the upper and lower parts respectively of the junction shown in FIG. 11.

In FIG. 1 is shown a tunnel lining assembly 10 including a series of monolithic tunnel lining sections 12-1 to 12-8. Section 12-1 is a lead section fitted with a cutting edge 14 at its forward end to assist in excavation of material in the way of the tunnel and provided at its rearward end with an external circumferential rebate 16. The remaining sections 12-2 to 12-8 are identical, each being provided with a rebate 16 at its rearward end and with a similar rebate 18 at its forward end. At the junction between each adjacent pair of sections a cylindrical metal or plastics sleeve 20 is securely fitted on each rearward rebate 18.

Figure 3:
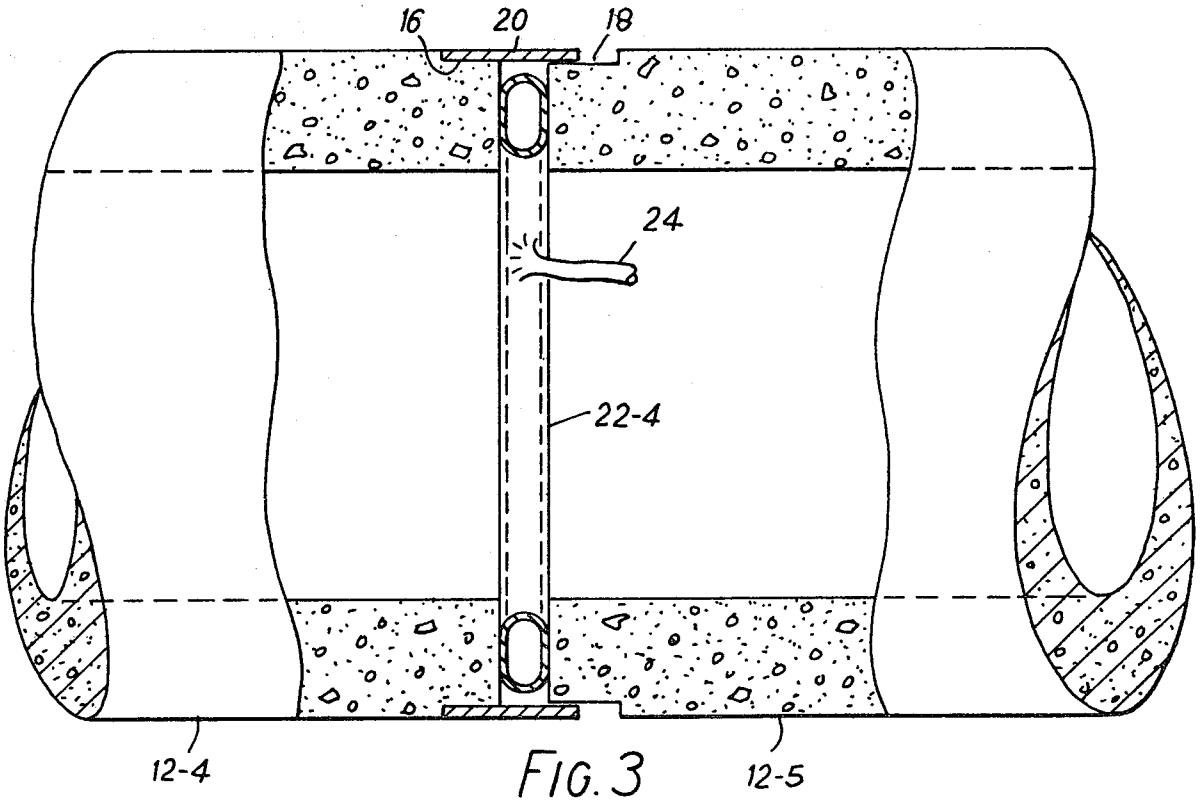
FIG. 3 is a side elevation of the assembly of FIG. 1, partly broken away at the junction between the fourth and fifth sections with an interposed torus inflated.
Figure 4:
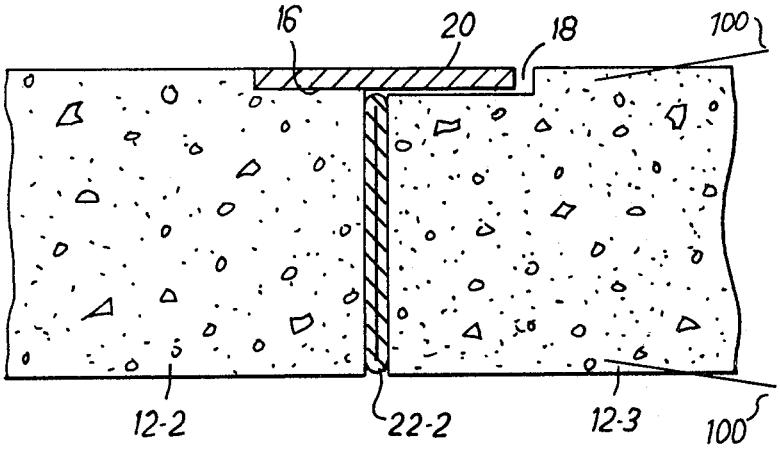
FIG. 4 is a detail of FIG. 3 with the interposed torus deflated.

The annular space lying between the ends of each adjacent pair of sections 12 and bounded on the outside by the sleeve 20 is occupied by a respective inflatable torus 22-1 to 22-7 formed of rubber or reinforced plastics material and having a fluid inlet 24 through which compressed air may be admitted to and exhausted from the torus. The junction between sections 12-4 and 12-5 with the torus 22-4 inflated is best shown in FIG. 3 and the upper portion of the junction between sections 12-2 and 12-3 with the torus 22-2 deflated is best shown in FIG. 4. The inlet 24 of the torus 22-1 at the first junction, the inlets 24 at every succeeding third junction are connected to a first compressed air main 26-1; similarly the torus 24-2 at the second and the tori 24 at every succeeding third junction are connected to a second compressed air main 26-2; and the torus 22-3 at the third junction and the tori 24 at every succeeding third junction are connected to a third compressed air main 26-3. Each main is connected to a source of compressed air and to atmosphere through a respective 3-way valve 27-1, 27-2 and 27-3.

Figure 5:
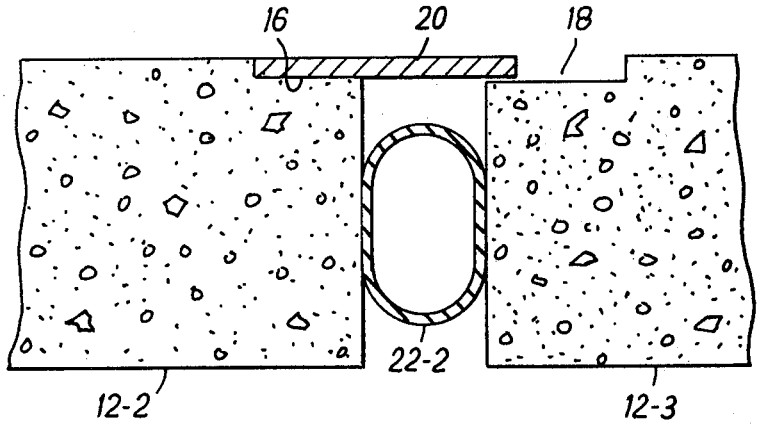
FIG. 5 is a view, similar to that of FIG. 4, with the torus inflated.

Considering FIG. 4, it can readily be seen that the collapsed torus 22-2, if supplied with air under pressure from the main 26-2 will, in striving to achieve a circular cross-section under the influence of the compressed air, exert a reaction upon the rearward face of the section 12-2 and an equal and opposite reaction upon the forward face of the section 12-3. It can also readily be seen that, if the section 12-3 is restrained prior to the admission of the air into the torus 22-2, the section 12-2 will move in the forward direction an amount determined by the quantity of air admitted. The junction will then be in the condition shown in FIG. 5 with the torus 22-2 inflated.

The tunnel lining assembly 10 can be made to move in the forward direction through sequential admission and exhaustion of air by a suitable arrangement of control valves on the mains 26-1, 26-2 and 26-3, as will now be described with reference to FIG. 6.

FIG. 6(*a*) shows sections 12-1 to 12-5 of the lining assembly 10 with the torus 22 at each of the junction in a deflated condition as represented in FIG. 4.

FIG. 6(*b*) represents the lining assembly 10 when compressed air has been admitted to the torus 22-1 at the junction between sections 12-1 and 12-2 and the section 12-1 has been advanced in the forward direction an amount corresponding to the increase in length of the junction between sections 12-1 and 12-2.

FIG. 6(*c*) represents the lining assembly 10 when compressed air has been admitted into the torus 22-2 junction and the air allowed to exhaust from the torus 22-1.

FIG. 6(*d*) represents the lining assembly 10 when compressed air has been admitted to the torus 22-3 and the air allowed to exhaust from the torus 22-2.

It can now readily be seen that the sections 12-1, 12-2 and 12-3 have all advanced in the forward direction an amount corresponding to the original increase in length of the junction between sections 12-1 and 12-2; and it can be further seen that by repeating the three cycles of operation in sequence, that the sections 12-1, 12-2 and 12-3 can be made to progress in the forward direction provided always that there is a suitable reaction available rearwardly of the torus 22 being inflated. This reaction, particularly in the initial stages of advancing the assembly 10, may be provided by any suitably strong structure with which the section 12 immediately behind the torus 22 being inflated is in direct engagement or is in indirect engagement through one or more sections 12 with the interposed tori 22 deflated.

Typically, the system is operated with compressed air at a pressure of 488.2 kg/sq.meter (100 psi). The monolithic tunnel lining sections 12 have an internal diameter of 122 centimeters (48 inches) and a wall thickness of 10.2 centimeters (4 inches); and the tori 22 have an internal diameter of 122 centimeters (48 inches) and an external diameter of 142.2 centimeters (56 inches) in a deflated condition.

In an inflated condition, the length of the junction between the sections 12 is 3.8 centimeters (1½ inches) and the torus 22 exerts a thrust of 12,192 kg (12 tons) on the end face of the preceding section 12.

At initiation of the advance of a section 12 when the junction is closed, the initial thrust on admission of the compressed air is 29,464 kg (29 tons).

An alternative driving fluid supply and control system will now be described with reference to FIG. 7. In the alternative system the three compressed air mains are replaced by a single main 28 which is connected to a source 30 of compressed air and which has branches 32-1 to 32-7 to a series of pneumatically-operated spring-return control valves 34-1 to 34-7 which are connected to the tori 26-1 to 26-7 respectively by lines 36-1 to 36-7 and are fitted with discharge vents 37-1 to 37-7. Each of the valve 34-1, 34-4 and 34-7 is controlled by a pilot line 38; each of the valves 34-2 and 32-6 by a pilot line 40; and each of the valves 34-3 and 34-5 by a pilot line 42. Each of the lines 38, 40 and 42 is connectible to a common supply 44 by a rotary valve 46.

Where no solid structure is available to provide a reaction any particular section 12 will progress in the forward direction, when compressed air admitted to one of the tori 22 provided at the junction between it and the adjacent rearward section 12, provided that the two adjacent rearward sections 12 are in thrust-transmitting engagement at their common junction, either with or without the interposition of an deflated torus 22, such that the sum total of the friction between the outer surface of the two sections 12 and the surrounding soil is greater than the friction between the soil the particular section 12 being moved in the forward direction.

This principle may be used to achieve perichaetial (or wormlike) forward movement of the tunnel lining assembly 10, a description of which now follows with reference to the system of FIG. 7 and also to FIG. 8 which illustrates stages of the advance.

To initiate advance valve 34-1 is set to a supply condition by operation of the rotary valve 46 to admit compressed air to the torus 22-1, supply to the tori 22-4 and 22-7 being prevented by operation of manual control valves (not shown) in the lines 36-4 and 36-7. Consequent inflation of the torus 26-1 causes advancement of the lead section 12-1 so that the assembly 10 achieves the state shown in FIG. 8(*a*) in which sections 12-1 and 12-2 are separated at the first junction. The valve 34-2 is then opened in a similar manner by actuation of the pilot line 40, the valve 34-1 automatically re-setting itself to a vent condition once the pilot line 38 is depressurised to allow the pressure in the torus 22-1 to fall to atmospheric. Section 12-2 is consequently moved forward by the force exerted by the inflating torus 22-2 to close the first junction and to flatten the first torus 22-1, exhausting the residual air from it via the line 36-1 and vent 37-1. The assembly 10 thus reaches the condition shown in FIG. 8(*b*) and a corresponding sequence of operations is then repeated to effect advancement of the third torus 22-3 so that the assembly 10 assumes the condition represented in FIG. 8(*c*) in which sections 12-1, 12-2 and 12-3 have all moved an equal distance forward.

Next values 34-1 and 34-4 are set to the supply condition by pressurisation of the pilot line 38 so that sections 12-1 and 12-4 are moved forward and the assembly 10 assumes the condition illustrated in FIG. 8(*d*). The above-described sequence of operations is then repeated in respect of valves 34-2 and 34-3 in conjunction with valves 34-5 and 34-6 respectively so that the assembly passes through the stage represented in FIG. 8(*e*) to that represented in FIG. 8(*f*).

When the above sequence of operations is initiated a third time to include the opening of valve 34-7 simultaneously with valves 34-1 and 34-4 by pressurising pilot line 38 the FIG. 8(*g*) condition is reached in which the first, second and third junctions are open. Subsequent operation of the set of three valves 34-2, 34-5 and 34-8 (not shown) controlled by pilot line 30 and the set of three valves 34-3, 34-6 and 34-9 (not shown) will cause the assembly 10 to pass through the conditions represented in FIGS. 8(*h*) and 8(*i*) respectively. Finally, FIG. 8(*j*) shows the condition of the sections 12-1 to 12-10 when the valve 34-1 and the three further valves linked to pilot line 38 have been actuated.

From the foregoing it can readily be seen that, by arranging for compressed air to be admitted to and allowed to exhaust from the first group of tori 22-1, 22-4 . . . , the second group of tori 22-2, 22-5 . . . , and the third group of tori 22-3, 22-6 . . . , in a consecutive fashion, the lining tunnel assembly 10 will be given perichaetial movement in the forward direction at a speed depending upon the rate at which air is admitted and exhausted from the respective groups of tori 22; and it will also be apparent that the operation of the mechanics of the propulsion system as above described is simple. Finally, after each tunnel lining section has achieved its correct position the torus 22 behind it can be removed to allow the following torus 22 to engage it on its final advance.

The advantage of the embodiment of FIG. 7 is that only single compressed air main 28 is required and there is no lost gas other than that which has lost its energy.

In other embodiments of the invention it can be arranged that each torus 22 is used to propel more than one lining section 12; for example, two or three lining sections 12 in direct contact at their junctions, by locating an inflatable torus 22 at every second or third junction along the tunnel lining assembly. The advantage of these other embodiments is that the forward motion can be speeded up for any particular supply volume of driving fluid.

Moreover, in these other embodiments, tori 22 can be introduced as before between each pair of adjacent lining sections 12 and, whereas initially only every second or third torus 22 is utilised as an operating torus, should the friction on the outside of the tunnel lining assembly 10 increase as a result of changes in the type of soil encountered during the progress of the tunnel, resort can be made to utilising each, or every second, torus 22 as an operating torus. This can be readily achieved by having the main 28 provided with self-sealing 'T' connections at each lining section junction and connecting the respective torus 22 to the main 28 as may be required.

In a further embodiment the leading section 12-1 of the tunnel lining section assembly 10 is replaced by a steerable tunnel shield assembly indicated generally in FIG. 9 by the reference 50. The assembly 50 comprises a circular section shield 52 which is provided at its forward end with a cutting edge 54 and is extended rearwardly as an annulus 56. Forming an internal shoulder at the base of the annulus 56 is an annular bulkhead 58 on which are mounted four hydraulic rams 60-1 to 60-4. Located within the sleeve 56 and connected in an articulated fashion to pistons 61 of the hydraulic rams 60 is a stiff thrust ring 62 which can be moved axially and included to a plane normal to the axis.

Interposed between the thrust ring 62 and the forward face of the tunnel lining section 12-2 is the inflatable flexible torus 22-1 which is shown in FIG. 9 in an inflated condition. In FIG. 9 the pistons 61 of the rams 60 are equally extended and the thrust ring 62 is normal to the axis of the shield 52. In achieving the inflated condition the torus 22-1 will have acted to move the shield 52 in an axial direction.

FIG. 11 shows the tunnel shield assembly 70 arranged to steer the tunnel in an upward direction. To achieve this the two lower rams 60-3 and 60-4 have been extended with the torus 22-1 in a deflated condition and the upper rams 60-1 and 60-2 kept retracted, causing the thrust ring 62 to present a plane inclined to that defined by the forward edge of the tunnel lining section 12-2.

When compressed air is admitted to the torus 22-1, it will assume a shape which is wider at the upper part of the thrust ring 62 and narrower at the lower part of the ring 62. FIG. 12 shows the sectional shape of the torus 22-1 at the upper part of the ring 62 and it will be seen that the length of contact $L_1$ of the torus 22-1 with the ring 62 is there less than the length of contact $L_2$ at the lower part of the ring 62 as shown in FIG. 13.

Since the air pressure will be equal throughout the interior of the torus 12-1, the thrust created by the torus 12-1 will be greater towards the bottom of the shield 52 than towards the top. This will result in the centre of thrust caused by the inflated torus 12-1 being below the axis of the shield 52, resulting in a couple tending to rotate the shield 52 in an upward direction.

It can readily be seen that by suitable adjustment of the hydraulic rams 60, thereby altering the plane of the thrust ring 62, a steering effect can be achieved in any desired direction, either horizontally or vertically under action of the torus 12-1 when inflated by compressed air.

It can also readily be seen that all embodiments of the invention herein described equally apply to the installation of vertical or steeply inclined linings to shafts.

Although the driving fluid employed in the above-described embodiments is compressed air other fluids may be used, for example a liquid such as water, in which case a reservoir will need to be provided.

In some circumstances it may be advantageous to increase the resistance of the sections to rearward movement by providing them with rearwardly projecting elements which will lie substantially flat against the outer surface of the section to allow forward movement but will dig into the surrounding medium to increase resistance to rearward movement if such movement is initiated. Preferably, as shown in FIG. 4, the elements are mild steel wires 100 which are cast into the concrete of the section and project rearwardly from its outer surface in an axial plane and in a direction inclined by about 5° to 10° to the axial; the exposed length of each wire is about 10 cm. It can readily be seen that in suitable soil conditions the provision of such elements enables a single section to provide sufficient reaction to the rearward thrust exerted by the torus as it is inflated to cause the preceding section to be advanced. Perichaetial advance can thus be achieved by simultaneously advancing every evenly numbered section or group of sections alternately with every odd numbered section or group of sections. It is of course not necessary for every section in each group to be provided with such elements for engaging the surrounding medium.

I claim:

1. A method of non-disruptively installing a tunnel or shaft lining through a medium such as soil by longitudinally advancing an assembly of tunnel lining sections arranged in end to end relationship, which method comprises inflating with driving gas at relatively low pressure an inflatable torus formed of flexible material and capable of being inflated into the shape of a toroid located between a forward and a rearward section, the torus in the deflated state being in a generally flat condition, whilst restraining the outward expansion of the torus and preventing backward movement of the rearward section to cause the forward section to advance, the backward movement being prevented by the combined friction of the rearward section and the next rearward section with the surrounding medium which provides a reaction substantially equal to the rearward thrust exerted by the torus as it is inflated, and the sections in the assembly being grouped into equally-numbered groups of at least three, with the leading section of one group being axially spaced from the rearmost section of the preceding group and each member of each group being in thrust-transmitting engagement, and corresponding sections in each group being simultaneously advanced in sequence such that the section or sections being advanced always have at least double their number of sections in thrust-transmitting engagement behind them to prevent backwards movement, whereby the assembly is advanced perichaetially, the leading section being constituted by a tunnel shield of a diameter equal to the nominal diameter of the sections, so that there is essentially no over-cut in the medium, whereby settlement of the medium above the tunnel or shaft lining is avoided or at least significantly mitigated.

2. A method as claimed in claim 1, wherein the face which the leading section presents to the leading torus is inclined in a plane normal to the axis of the rearward section so that the thrust exerted by the torus as it is inflated is offset from the axis of the leading section creating a couple which causes the leading section to be advanced in a path diverging from the axis of the rearward section, whereby the assembly is rendered steerable in any desired direction.

3. A method as claimed in claim 1, wherein the backwards movement is prevented by the provision, on the outer surface of the rearward section, of members which engage the surrounding medium to anchor the section against further backwards movement if such movement is initiated but which lie substantially flat against the outer surface during forward movement.

4. A method as claimed in claim 1, wherein the sections in the assembly are grouped into equall-numbered groups of two or a multiple thereof, with the leading section of one group being axially spaced from the rear section of the preceding group and each member of each group being in thrust-transmitting engagement, and the section or sections of the leading half of each group are simultaneously advanced alternately with the section or sections in the rear half of each group, whereby the assembly is advanced perichaetially.

5. An assembly of tunnel lining sections for the non-distruptive installation of a tunnel lining, the assembly comprising two tunnel lining sections arranged end-to-end and externally rebated at the adjacent ends, a cylindrical sleeve in which the rebated ends are received with at least one end being slidably received, an inflatable torus accommodated in the annular space defined by the adjacent end faces and the respective sleeve and supply and exhaust means to admit driving gas to, and to exhaust driving gas from, the torus, the torus being formed of flexible material and capable of being inflated into the shape of a toroid located between said faces and deflated to a generally flat condition and still located between said facing surfaces, which comprises a multiplicity of such pairs of sections and interposed tori and in which the driving gas supply and exhaust means comprise a main supply line connectable to a source of driving gas under pressure and connected to each torus through a valve which in a first condition allows the supply of driving gas under pressure to the torus and in a second condition allows the torus to exhaust, the sections in the assembly being grouped into equally-numbered groups of at least three, with the leading section of one group being axially spaced from the rearmost section of the preceding group and each member of each group being in thrust-transmitting engagement, and means for simultaneously advancing corresponding sections in each group in sequence such that the section or sections being advanced always have at least double their number of sections in thrust-transmitting engagement behind them and in frictional contact with the surrounding medium to prevent backwards movement by providing a reaction substantially equal to the rearward thrust exerted by each torus as it is inflated, the assembly being advancible perichaetially, the leading section being constituted by a tunnel shield of a diameter substantially equal to the nominal diameter of the sections to constitute a means for cutting the medium with essentially no over-cut in the medium to substantially avoid settlement of the medium above the tunnel or shaft lining.

6. An assembly as claimed in claim 5, in which the valves are pilot-operated.

7. An assembly as claimed in claim 6, in which the valves are hydraulically, electrically or pneumatically operated spring-action valves.

8. An assembly as claimed in claim 5, in which the valves controlling the first, fourth and every subsequent third torus, the second, fifth and every subsequent third torus and the third, sixth and every subsequent third torus are grouped for simultaneous operation.

9. An assembly as claimed in claim 5, which comprises a multiplicity of such pairs of sections and interposed tori and in which the first, fourth and every subsequent third torus, the second, fifth and every subsequent third torus, and the third, sixth and every third torus are connected to a respective one of three mains supply lines each controlled by a corresponding valve means to admit driving gas to, and to allow release of gas from, the connected tori.

10. An assembly as claimed in claim 5, wherein the sections in the assembly are grouped into equally-numbered groups of two or a multiple thereof, with the leading section of one group being axially spaced from the rear section of the preceding group and each member of each roup being in thrust-transmitting engagement.

11. An assembly as claimed in claim 5, in which at least some sections are provided on their outer surfaces with members which lie substantially flat against the surface when the section is being advanced but are raised to engage the surrounding medium if backwards movement is initiated.

12. An assembly as claimed in claim 5, which additionally comprises steering means which create a couple between the thrust exerted by inflation of the adjacent torus and the axis of the leading section.

13. An assembly as claimed in claim 12, in which the steering means comprise a thrust ring engaging the torus and adjustment means for altering the inclination thereof to the plane normal to the axis of the leading section.

14. An assembly as claimed in claim 13, in which the adjustment means comprise at least three hydraulic rams mounted on the leading section.

15. An assembly as claimed in claim 5, in which the driving gas is compressed air.

* * * * *